US005228409A

United States Patent [19]

Hodonsky

[11] Patent Number: 5,228,409

[45] Date of Patent: Jul. 20, 1993

[54] FOLDING ARM FOR BOAT COVER

[76] Inventor: Pamela J. Hodonsky, 8271 Ledgewood Ct., Fenton, Mich. 48430

[21] Appl. No.: 844,765

[22] Filed: Mar. 2, 1992

[51] Int. Cl.[5] ..... B63B 17/00

[52] U.S. Cl. ..... 114/361; 123/195 C

[58] Field of Search ..... 123/195 C, 195 P, 195 R; 114/111, 361, 343, 349; 441/38; 135/88, 114, 905, 87, 116, 99; 150/154, 166

[56] References Cited

U.S. PATENT DOCUMENTS 2,474,031 6/1949 Burns ..... 114/361
3,136,288 6/1964 Hardy ..... 440/111
3,896,832 7/1975 Montoya ..... 114/361
4,996,937 3/1991 Miina ..... 440/111
5,009,184 4/1991 Voldrich ..... 114/361

*Primary Examiner*—Joseph F. Peters, Jr.
*Assistant Examiner*—Clifford T. Bartz
*Attorney, Agent, or Firm*—Charles W. Chandler

[57] ABSTRACT

A recreational boat having an engine housing for covering an inboard engine, and an arm pivotally mounted on the engine housing for movement between a lower position in which the arm is stored in an elongated recessed opening in the housing, and a raised position in which a portion of the arm is disposed above the engine housing, and a flexible fabric boat cover which overlies the boat and is supported by the arm in its raised position.

7 Claims, 2 Drawing Sheets

FOLDING ARM FOR BOAT COVER

BACKGROUND OF THE INVENTION

This invention is related to a boat cover support that may be pivoted between a recessed position in the engine housing of a recreational boat, and a raised position in which a portion of the arm is disposed above the engine housing for supporting a flexible boat cover.

Recreational boats having an open passenger compartment are commonly covered with a flexible boat cover when in storage. The boat cover overlies the entire passenger compartment and has its edges connected to the hull. Typically, an internal support or brace is mounted in the boat to support the central portion of the flexible cover in a raised position such that moisture and light debris will drain off the cover. The support is usually a vertical pole temporarily mounted in the boat. The cover is connected to the upper end of the pole.

Other forms of supports are known in the art, such as is illustrated in U.S. Pat. No. 2,474,031 which was issued Jun. 21, 1949 to Frank D. Burns. Some boats employ a hinged frame adapted to support a covering or tarp in a raised position when the boat is in use. The tarp provides protection from the sun or rain. Such prior art is illustrated in U.S. Pat. No. 5,009,184 which was issued to Thomas Voldrich, Apr. 23, 1991.

SUMMARY OF THE INVENTION

The broad purpose of the present invention is to provide a boat cover supporting arm that is both stored on and supported by the engine housing of an inboard engine boat. The arm is a permanent part of the boat. In its stored position, the arm is received within a recessed part of the engine housing to blend into the contour of the engine housing. It may be upholstered similar to the engine housing. Pivot means connect the arm to the engine housing. When the boat is to be covered by the conventional fabric cover, the arm is raised and supported by a brace which provides the arm with sufficient rigidity to support the boat cover.

The arm provides several advantages over such prior art as I am aware. For example, the arm replaces the conventional loose poles which normally have no designated storage location on the boat. The attachment of the arm to the engine housing eliminates the possibility of the arm being dropped overboard, being misplaced or stolen.

The arm is aesthetically superior to a loose support.

The brace supports the arm such that it does not have to be held in place as the user installs the boat cover.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views.

DESCRIPTION OF THE PREFERRED EMBODIMENT OF THE INVENTION

Figure 1:
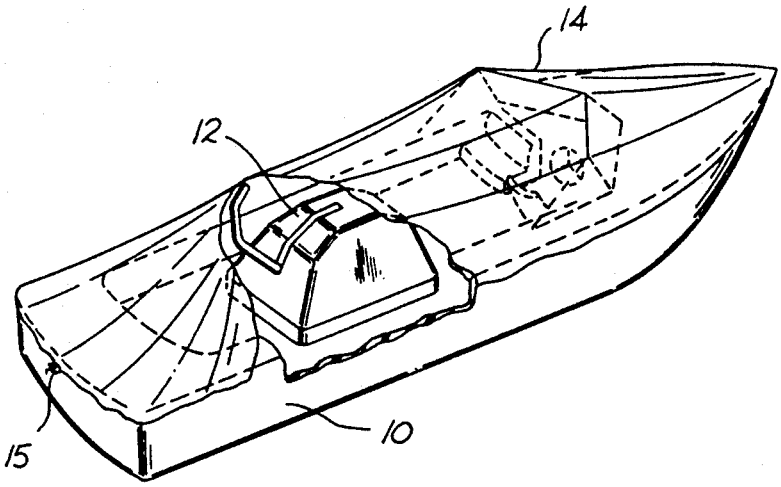
FIG. 1 illustrates a fabric boat cover mounted on an arm illustrating the preferred embodiment of the invention.

Referring to the drawings, a conventional, recreational boat 10 is illustrated in FIG. 1. The boat is of the type having an inboard engine and may be, for example, a recreational boat offered by the Mastercraft Boat Company of Maryville, Tennessee. Boats of this type have a fiberglass inboard engine housing 12. The engine housing is located approximately in the midsection of the boat.

A flexible fabric cover 14 is employed for covering the boat when it is not in use. The edges of cover 14 are tied as at 15, in a position below the upper edge of the hull in the manner well known to those skilled in the art.

The conventional practice is to support the cover in such a manner that rainwater will drain off the cover. A vertical pole (not shown) is commonly mounted immediately rearward of the engine housing. The upper end of the pole supports the cover in a raised position. When the pole is not being used, it is a loose object that can be misplaced or accidentally knocked overboard.

Figure 3:
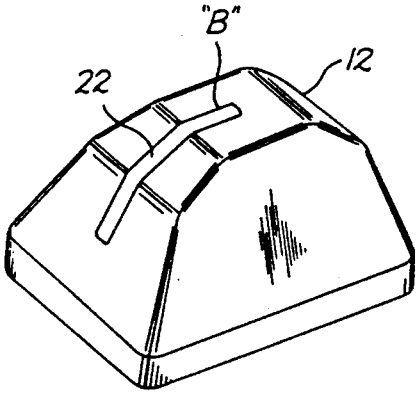
FIG. 3 is a view of the arm in its lower stored, position on the engine housing.
Figure 4:
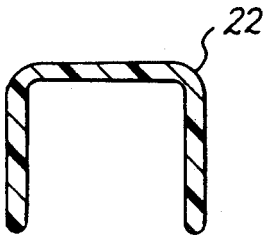
FIG. 4 is a transverse sectional view of the arm.
Figure 5:
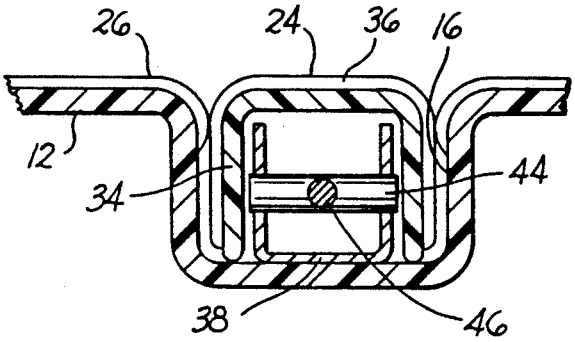
FIG. 5 is cross-sectional view showing the arm seated in the recessed opening in the engine housing.
Figure 6:
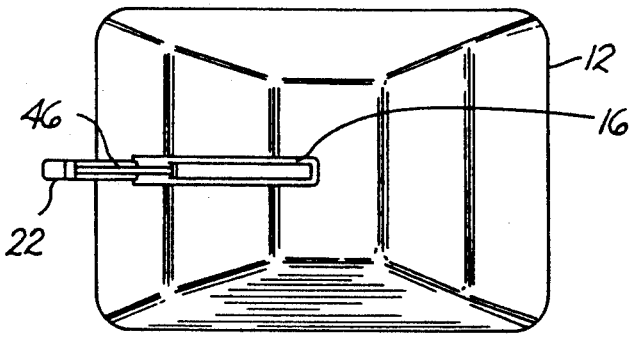
FIG. 6 is a plan view of the arm and the engine housing.

Engine housing 12 has a hood-like configuration that includes a central roof portion overlying the engine, and a downwardly extending peripheral skirt portion. The housing has an elongated recessed opening 16 having an upper end 18. The recessed opening or groove 16 follows the curvature of the housing rearwardly such that its lower end is disposed at 20. An arcuate or angulated arm 22 is received in the recess, as illustrated in FIG. 3. The arm has a longitudinal configuration conforming to that of the recess so that in its stored position, as illustrated in FIG. 5, the outer surface 24 of the arm 22 is flush with the outer surface 26 of the engine housing. Preferably, the arm has substantially the same length as the recess.

Figure 2:
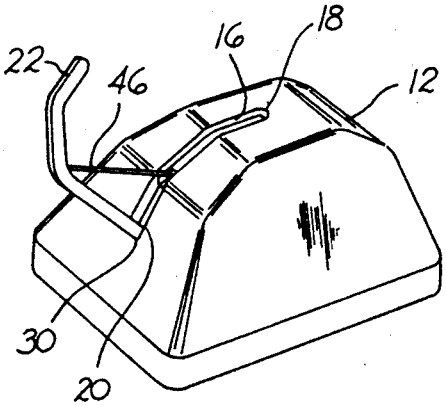
FIG. 2 is a view of the arm in its raised position on the engine housing.

Pivot means 30 in the recess, pivotally connect the lower end of the arm to the engine housing, as illustrated in FIG. 2. Thus, the arm is movable between a raised position illustrated at "A" in FIG. 7 to a lower, stored position illustrated at "B" in FIG. 3.

Referring to FIG. 5, the arm has a channel-shaped fiberglass body 34 with a upholstered surface, as at 36, to match the surface of the balance of the engine housing.

Figure 8:
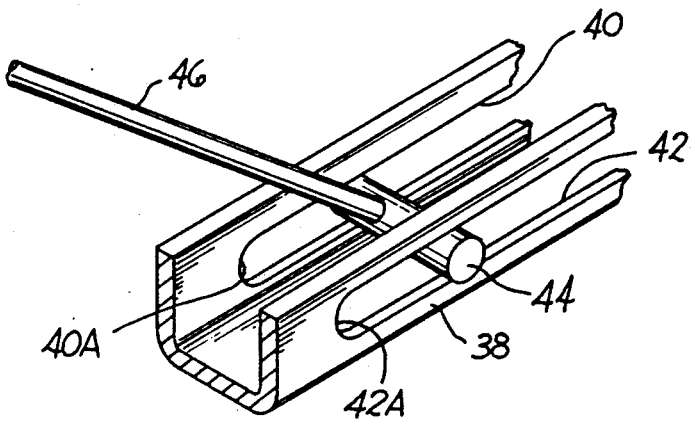
FIG. 8 is a fragmentary view showing the lower end of the brace slidable mounted in a track in the storage opening.

Referring to FIG. 8, a channel-shaped track 38, preferably of aluminum, is mounted in the upper end of recessed opening 16. Track 38 has a pair of parallel, longitudinal slots 40 and 42 in its opposite upstanding side walls. A finger or pin 44 has its ends slidable mounted in slots 40 and 42.

Figure 7:
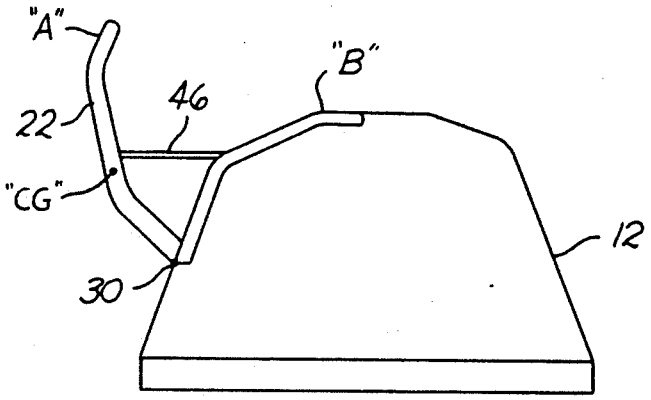
FIG. 7 is an elevational view of the arm in its raised position.

An elongated brace 46 has one end attached to finger 44. The finger is slidable along the slots, and abuts the ends of the slots at 40A and 42A respectively, when arm 22 is in its fully open position, as illustrated in FIG. 7. Brace 46 defines the rearward, open position of the arm.

As the arm is pivoted downwardly and forward toward its recessed position, finger 44 moves forwardly in the slots until the arm is fully recessed in a stored, closed position.

Referring to FIG. 7, the center of gravity of the arm, generally indicated at "CG", is rearward of the arms pivot point 30. As the arm is swung toward its forward, lower position, the center of gravity moves toward the opposite side of the pivot point. The weight of the arm biases the arm toward either its fully raised or its fully closed position.

In its raised position, the upper end of the arm is located above the engine housing to support the boat cover in a raised position so that any rain or light debris on the cover flows down and over the side of the hull.

In its lower position, the arm is fully recessed in opening 16 providing an attractive means for storing the arm. The arm is an integral, but movable part, of the boat structure which obviates the problem of the arm being lost overboard. Further, when the arm is in its open position "A", the arm is supported such that the user can readily lay the boat cover over the open boat structure.

Having described my invention, I claim:

1. In a boat having a hull, an inboard engine located in an intermediate position along the hull length, and a flexible cover adapted to overlie the hull and the engine, with edge areas of the cover fitting around edges of the hull, the improvement comprising;

a hollow upright housing overlying said inboard engine, said engine housing having a hood-like configuration surrounding the engine so that the engine is not visible to passengers in the boat; said engine housing having an interior surface facing the engine, and an exterior surface facing away from the engine;

the exterior surface of said housing having an elongated groove extending in a vertical plane, said groove having a relatively long length dimension and a relatively short width dimension;

an elongated arm having length and width dimensions corresponding to the length and width dimensions of said groove whereby said arm is enabled to fit within said groove with one surface of the arm substantially flush with the associated area of the housing exterior surface;

said arm having one end thereof pivotably attached to said housing such that said arm can be swung between a lowered position located within said groove and a raised position extending upwardly out of said groove; said arm having its other end located a measurable distance above the engine housing when said arm is in its raised position, whereby said arm is enabled to support the flexible cover in a condition sloping from the arm outwardly and downwardly to the associated cover edge areas.

2. The improvement of claim 1, wherein said arm has a pivot connection with said housing, said pivot connection being located so that when the arm is in its lowered position, the center of gravity of the arm biases the arm into said groove, and when the arm is in its raised position, the center of gravity of the arm biases the arm away from the groove.

3. The improvement of claim 1, and further comprising a track located within said groove, and an elongated brace fitting within said track; said brace having one end thereof slidably and captively engaged with the track and an opposite end swingably connected to said arm, whereby said brace limits swinging motion of the arm in the raising direction.

4. The improvement of claim 3, wherein said arm has a channel-shaped cross section comprising a web and two flanges; said arm being oriented to said groove so that when the arm is in its lowered position, the web portion of the arm lies substantially flush with the associated area of the housing exterior surface.

5. The improvement of claim 4, wherein said track has a lesser width dimension than the spacing between the flanges of the channel-shaped cross sectioned arm, whereby the track nests within the arm flanges when the arm is in its lowered position.

6. The improvement of claim 5, wherein said track comprises two parallel walls, each wall having a linear slot extending therealong; said brace comprising a rod adapted to fit between the track walls, and a transverse pin extending from said rod through the linear slots, whereby when said arm is moving between its raised and lowered positions, the transverse pin travels along the linear slots.

7. In a boat having a hull, an inboard engine located within the hull in an intermediate position along the hull length, and a flexible cover adapted to overlie the hull and the engine, with edge areas of the cover fitting around the hull edges, the improvement comprising:

a hollow upright housing overlying said inboard engine, said housing having a hood-like configuration that includes a central roof and a peripheral skirt extending downwardly from said roof so as to surround the engine; said housing having a concave interior surface facing the engine, and a convex exterior surface facing away from the engine;

the exterior surface of said housing having an elongated angulated groove extending in a vertical plane within portions of the roof and skirt whereby said groove has an arcuate side profile configuration, said groove having a relatively long length dimension and a relatively short width dimension;

an elongated arcuate arm conforming to the side profile configuration of said groove, said arm having length and width dimensions corresponding to the length and width dimensions of said groove whereby said arm is enabled to fit within said groove, with one surface of the arm flush with the associated area of the housing exterior surface;

said arm having one end thereof pivotably attached to said housing at the lowermost end of said groove, such that said arm can be swung between a lowered position located within said groove and a raised position extending upwardly out of said groove;

said arm having its other end located a measurable distance above the engine housing when said arm is in its raised position, whereby said arm is enabled to support the flexible cover in a condition sloping from the arm outwardly and downwardly to the associated cover edge areas.

* * * * *